US005397687A

United States Patent [19]

Willems et al.

[11] Patent Number: 5,397,687

[45] Date of Patent: Mar. 14, 1995

[54] X-RAY SILVER HALIDE PHOTOGRAPHIC MATERIAL SUITABLE FOR RAPID PROCESSING SYSTEMS

[75] Inventors: Peter Willems, Stekene; Freddy Henderickx, Olen; Gino De Rycke, Mortsel; Romain Bollen, Sint-Truiden, all of Belgium

[73] Assignee: AGFA-Gevaert, N.V., Mortsel, Belgium

[21] Appl. No.: 166,354

[22] Filed: Dec. 14, 1993

Related U.S. Application Data

[63] Continuation of Ser. No. 964,263, Oct. 21, 1992, abandoned.

[30] Foreign Application Priority Data

Oct. 24, 1991 [EP] European Pat. Off. ..... 91202761

[51] Int. Cl.[6] ..... G03C 1/46

[52] U.S. Cl. ..... 430/502; 430/621; 430/133; 430/966; 430/564; 430/567; 430/428; 430/430; 430/434; 430/436; 430/438

[58] Field of Search ..... 430/621, 502, 133, 966, 430/564, 567, 428, 430, 434, 436, 438

[56] References Cited

U.S. PATENT DOCUMENTS

| | | | |
|---|---|---|---|
| 3,671,258 | 6/1972 | Taber | 430/966 |
| 4,232,116 | 11/1980 | Jamieson | 430/510 |
| 4,650,746 | 3/1987 | Simson et al. | 430/438 |
| 4,650,746 | 3/1987 | Simson et al. | 430/438 |
| 4,826,757 | 5/1989 | Yamada et al. | 430/621 |
| 4,826,757 | 5/1989 | Yamada et al. | 430/621 |
| 4,837,143 | 6/1989 | Komorita et al. | 430/621 |
| 5,041,363 | 8/1991 | Sakuma | 430/436 |
| 5,112,731 | 5/1992 | Miyasaka et al. | 430/567 |

OTHER PUBLICATIONS

Research Disclosure, vol. 308, Item 308119, X, pp. 1004–1005, Dec., 1989, Kenneth Mason Pub. Ltd., Anonomous.

*Primary Examiner*—Thomas R. Neville
*Attorney, Agent, or Firm*—Breiner & Breiner

[57] ABSTRACT

The preparation of x-ray materials, especially suitable for non-destructive testing applications, is described. The emulsion layers of said material are comprising silver halide emulsion grains containing at least 75 mole % of silver chloride and less than 25 mole % of silver bromide and are characterized by a ratio between the amount of gelatin and the amount of silver halide, being expressed as the equivalent amount of silver nitrate, of less than 0.6. Hardening of said material is performed in such a way that the amount of demineralized water of 25° C. absorbed in 3 minutes is less than 2.5 g per gram of gelatin present in said material. A rapid processing system is available with a total processing time of less than 3 minutes with a developer and fixer being substantially free from hardening agents and the fixer being substantially free from ammonium ions.

13 Claims, No Drawings

X-RAY SILVER HALIDE PHOTOGRAPHIC MATERIAL SUITABLE FOR RAPID PROCESSING SYSTEMS

This is a continuation of application Ser. No. 07/964,263, filed on Oct. 21, 1992, now abandoned.

FIELD OF THE INVENTION

The present invention relates to photographic materials for industrial radiography having silver halide emulsion grains rich in chloride and capable of being processed at accelerated speed and with more ecologically safe developer and fixing solutions.

BACKGROUND OF THE INVENTION

In the field of industrial radiography, especially for non-destructive testing applications, any time saving measure is welcome.

After exposure with direct-röntgen rays, industrial non-destructive testing film is automatically processed in a cycle, varying from 8 to 12 minutes, the tendency being to reduce the processing time to a maximum of 5 minutes.

A normal processing cycle is characterised by the following steps: developing at 28° C. and fixing, rinsing and drying at 26° C. The developer is normally composed of three concentrates that should be diluted in the right order: alkaline solution A contains hydroquinone, acidic solution B contains 1-phenyl-3-pyrazolidinone and acidic solution C contains glutaric dialdehyd as hardening agent. The need for the complex three-part packaged developer concentrates has been dictated by the fact that glutaric aldehyd tends to react with 1-phenyl-3-pyrazolidinone, that this pyrazolidinone is unstable in alkaline medium and that glutaric aldehyd tends to polymerize in alkaline medium. The fixer is composed of 2 concentrated solutions, whereby solution A contains the commonly used highly active ammonium thiosulphate as a fixing agent and solution B aluminum sulphate as a hardening agent. Hardening agents are necessary to lead the film through the processor without damages, to reduce the amount of water absorption and, as a consequence, the drying time. This drying time may be considered as the bottle-neck in speeding up the whole processing cycle since the same amount of water has to be evaporated in a shorter time. For rapid processing times shorter than 8 minutes the temperature of the developer would have to be increased in order to obtain satisfactory photographic characteristics and this is to the detriment of the physical characteristics.

In the field of industrial radiography it often happens that in order to examine a welded seam for off-shore applications, e.g. pipe-lines, very rapidly the film is taken out of the processor after an incomplete processing cycle of say 5 minutes and the still wet, incompletely fixed film is examined. As a result failure in the examination is not excluded, as image quality, especially detail rendering, is hardly sufficient because of incomplete processing.

When shortening processing time it is practically impossible to dissolve in the fixing step the non-developed silver halide crystals in a still acceptable short time. This is not only a consequence of the large amounts of silver halides necessary for direct-röntgen applications present in silver halide emulsion layers coated on both sides of the film support but also due to the fact that the silver halides used are silver bromoiodide grains. Bromoiodide grains are used for the following reason. In order to achieve high film speed, which is an indispensible asset especially for direct-röntgen applications, efficient absorption of the exposure radiation is a prime condition. It has been shown emperically that for x-rays the mass absorption coefficient is proportional to a power of the atomic number Z as has been described in the "Encyclopaedic Dictionary of Physics" vol. 7, p. 787, eq. 10, Ed. J. Thewlis, Pergamom Press, Oxford 1957. This strongly disfavours the use of chloride ($Z=17$) compared to bromide ($Z=35$) or iodide ($Z=54$).

The bromide and iodide ions released in the developer inhibit further development of the remaining developable silver halide crystals, so that the regeneration capacity of the developer has to be increased resulting in more consumption of chemicals, a higher cost and more environmental load. From the point of view of ecology the use of a fixer containing ammonium-thiosulphate is disadvantageous. The same applies to the use of hardening agents in the developing solutions and in the fixer as well. The three-part development chemistry and two-part fixing chemistry is also little consumer friendly. In the developer glutaric dialdehyd should be avoided as an undesired ingredient, whereas in the fixer the hardening agent is causing flocculation problems in certain circumstances.

OBJECTS OF THE INVENTION

A first object of the present invention is to provide a silver halide photographic material for industrial radiography which has a satisfactory photographic performance even in rapid processing, i.e. higher development and fixing efficiency.

A second object of the invention is to provide an increased efficiency and capacity in the processing of industrial photographic material while maintaining an excellent image quality, especially image sharpness, and good physical properties.

A third object of the invention is to provide a photographic material for industrial radiography which can be subjected to more ecological processing conditions in that less chemicals are consumed in both developing solution and fixer requiring less regeneration and in that the processing solutions are free from hardening agents thus offering the possiblity of using the more customer-friendly one-part packaging. Besides the fixer can be freed from ammonium ions.

Other objects will become apparent from the description hereafter.

SUMMARY OF THE INVENTION

The above objects are accomplished by a photographic silver halide material for industrial radiography comprising a film support and on one or both sides thereof at least one silver halide emulsion layer which is characterised in that each silver halide emulsion layer comprises as silver halide silver chloride or silver chlorobromide the amounts of bromide being at most 25 mole %; has a gelatin to silver halide (expressed as silver nitrate) ratio from 3:10 to 6:10 and an amount of silver halide corresponding to from 5 g to 15 g of silver per sq. m. and in that the photographic material has been fore-hardened to an extent such that when it is immersed in demineralised water of 25° C. for 3 minutes there is absorbed less than 2.5 g of water per gram of gelatin.

The present invention also provides a method of processing an exposed fore-hardened photographic material for industrial radiography as defined, comprising the steps of development, fixing,rinsing and drying characterised in that the total processing time is less than 5 minutes, preferably less than 3 minutes, and the processing is preferably substantially free from hardening agents.

The chloride rich silver halide grains provide satisfactory photographic performance even in rapid processing. A processing sequence free from hardening agents is made possible by reducing the coated amount of gelatin and simultaneously increasing the amount of hardener in the thinner emulsion layer. As a consequence the amount of water being absorbed after rinsing the film with water is reduced, offering the possibility to the film material to be completely dry within the proposed total processing time.

DETAILED DESCRIPTION OF THE PRESENT INVENTION

In accordance with the present invention the emulsions are emulsions containing silver chloride crystals or silver chlorobromide crystals containing up to 25 mol % bromide-ions.

For the preparation of gelatino silver chloride or chlorobromide emulsions used in accordance with the present invention conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains the gelatin concentration is kept from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. The gelatin to silver halide ratio then ranges from 0.3 to 0.6. Although the precipitation in connection with the present invention can be principally performed by one double jet step it is preferred to perform a sequence of a nucleation step and at least one growth step. Of the total silver halide precipitated preferably 0.5% to 5.0% is added during said nucleation step which consists preferably of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably established, e.g. a linearly increasing flow rate. Typically the flow rate at the end is about 3 to 5 times greater then at the start of the growth step. These flow rates can be monitored by e.g. magnetic valves.

There can be a homogeneous distribution of the silver halide used over the whole volume of the silver halide crystals, for which the composition of the halide solution remains unchanged during the whole precipitation. However, a core-shell or multistructure emulsion can be used wherefore the composition of the halide solutions is varied during the growth stage. The moment at which this change has to take place depends on the desired thickness of the core and the shell and on the amounts and the ratio of chloride to bromide ions that have to be built into the crystals. Within the scope of this invention an amount of not more than 25 mol % of bromide ions may be built into the silver halide crystals, whether it is built in homogeneously or, as is the case for core-shell emulsions, heterogeneously. In order to get a homogeneous silver halide crystal distribution after precipitation it is recommended that before the start and during the different stages of the precipitation the pAg is maintained between 105 and 85 mV during the nucleation step and preferably between 90 and 65 mV during the growth phase and pH is maintained between 5.2 and 5.8 preferably between 5.6 and 5.8. When using conventional precipitation conditions chloride rich silver halide emulsion grains show a cubic morphology with (100) crystal faces offering better developing characteristics than other crystallographic forms, as e.g. octahedral, rhombic dodecahedral or tabular silver chloride crystals, which require the use of so-called "growth modifiers" or "crystal habit modifiers". However, chloride emulsions having crystallographic form other than cubic can be used. The silver halide grains used in accordance with the present invention preferably have an average grain size from 0.3 to 1.0 μm.

After completion of the precipitation a wash technique in order to remove the excess of soluble salts is applied at a pH value which can vary during washing but remains comprised between 3.7 and 3.3 making use of a flocculating agent like polystyrene sulphonic acid. Normally the emulsion is washed by diafiltration by means of a semipermeable membrane, also called ultrafiltration, so that it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and Mignot U.S. Pat. No. 4,334,012. Preferably, at the start of the ultrafiltration, there is no pH and pAg adjustment; pH and pAg are the same as at the end of the preceding precipitation without any adjustment stage.

The emulsions present in the industrial radiographic materials of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mir Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripehers or by means of reductors e.g. tin compounds as described in GB 789,823, amines, hydrazine derivatives, formamidine-sulphinic acids etc.

The silver halide emulsion layer(s) in accordance with the present invention or the non-light-sensitive layers may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion at any stage of the emulsion preparation. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

The ratio of gelatin to silver halide (expressed as silver nitrate) in the silver halide emulsion layers of the photographic material according to the present invention is comprised between 0.3 and 0.6, preferably from 0.4 to 0.6.

The gelatin binder of the photographic elements according to the present invention can be hardened with appropriate hardening agents such as those of the epoxide type, those of the ethyl enimine type, those of the vinylsulfone type e.g. 1,3-vinylsulphonyl-2-propanol, aldehydes e.g. formaldehyde, glyoxal, and glutaric aidehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in European Patent Application No 90.201850.6 Hardening is to such an extent that when the photographic material is immersed in demineralized water of 25° C. at most 2.5 g of water is absorbed per gram of gelatin in 3 minutes.

The photographic elements under consideration may further comprise various kinds of surface-active agents in the photographic emulsion layer and/or in at least one other hydrophilic colloid layer. Preferred surface-active coating agents are compounds containing perfluorinated alkyl groups.

The photographic elements may further comprise various other additives such as e.g. compounds improving the dimensional stability of the photographic element, UV-absorbers, spacing agents and plasticizers.

The photographic material according to the present invention is preferably a duplitized material having on both sides of the film support emulsion layers. Both emulsion layers are overcoated with an antistress top layer.

The support of the photographic material in accordance with the present invention may be a transparent resin, preferably a blue coloured polyester support like polyethylene terephtalate. The thickness of such organic resin film is preferably about 175 μm. The support is provided with a substrate layer at both sides to have good adhesion properties between the emulsion layer and said support.

The photographic material can be image-wise exposed by means of an x-ray radiation source the energy of which, expressed in kV, depends on the specific application. Another typical radiation source is a radioactive $Co^{60}$ source. To reduce the effect of scattering radiation a metal filter, usually a lead filter, is used in combination with the photographic film.

For processing, preferably an automatically operating apparatus is used provided with a system for automatic replenishment of the processing solutions. Film materials in accordance with this invention may be processed in developer solutions of different compositions as e.g. hydroquinone-1-phenyl-3-pyrazolidinone, 1-phenyl -3-pyrazolidinone-ascorbic acid and ascorbic acid itself. An amount of potassium thiocyanate in the range of 0.1 to 10 g pro liter of the developer solution is recommended to obtain high gradation values. An amount of 25 to 250 mg of potassium iodide pro liter is particularly recommended to obtain a higher speed. The developer solution according to the invention has to be replenished not only for decrease of the liquid volume due to cross-over into the next processing solution but also for pH-changes due to oxidation of the developer molecules. This can be done on a regular time interval basis or on the basis of the amount of processed film or on a combination of both.

The development step can be followed by a washing step, a fixing solution and another washing or stabilization step.

For film materials comprising silver chloride or silver chlorobromide emulsions in accordance with the present invention it is possible to use sodium thiosulphate as a fixing agent, thus avoiding the ecologically undesired ammonium ions normally used.

Finally after the last washing step the photographic material is dried. The following examples illustrate the invention without however limiting it thereto.

EXAMPLE 1

General Preparation of the Photographic Material

A silver chloride emulsion was prepared by a double jet technique. The silver halide composition was 100 mole % of chloride and the average grain size was 0.40 μm using methionin as a growth accelerator in an amount of 16 g pro 3.3 l starting volume in the vessel, containing 100 g of inert gelatin and 38 mmoles of sodium chloride at 60° C. Concentrated solutions of 1 l of $AgNO_3$ and NaCl, 3N each, were run with the double jet technique at a rate of 83 ml pro minute for the silver nitrate solution; 91 ml pro minute for the sodium chloride solution. After physical ripening during 12 minutes, pAg was about 70 mV and the flocculation procedure could begin: pH was adjusted at a value of 3.3 with sulphuric acid, 3M, and 6.7 g of polystyrene sulphonic acid was added slowly in 2 minutes. The washing procedure was performed in a discontinous way, adding 3 l of demineralised water, containing up to 8 mmole of sodium chloride pro liter, until pAg was reaching a value of about 100 mV. After addition of inert gelatin to a ratio of gelatin to silver nitrate in the emulsion of about 0.5, the emulsion was peptised and was chemically ripened to an optimal fog-sensitivity relationship at 52° C., pAg having a value of about 125 mV. Chemical ripening agents, besides gold (in an amount of 0.027 mmole) and sulphur (in an amount of 0.089 mmole), were toluene thiosulphonic acid and iodide ions, both being predigestion agents in amounts of 4 mg and 18 mmoles respectively. Stabilizers as the sodium salt of 7-sulpho-naphto-[2,3-D]-oxazoline-2-thion and 1-phenyl-5-mercaptotetrazole were added in amounts of 40, respectively 30 mg pro 100 g $AgNO_3$.

The emulsion was coated at both sides of a substrated blue polyester of 175 μm thickness by means of the slide hopper technique, the emulsion layers each containing silver halide emulsion crystals, expressed as $AgNO_3$, in an amount of 10.5 g/m$^2$ and in an amount of 5.25 g/m$^2$ gelatin. Both emulsion layers were covered with a protective layer coated at 1.40 g/m$^2$ of gelatin and hardened with formaldehyd and resorcinol to such an extent that when immersed in demineralized water of 25° C. for 3 minutes about 2 g of water was absorbed.

Exposure Conditions

The coated and dried films were exposed with a 86 kV x-ray radiation source placed at a distance of 1.50 m and in contact with a copper filter with a thickness of 1 mm (indicated as exposure A in the further examples) or with a 235 kV radiation source placed at a distance of 1.50 m in contact with a copper filter of 8 mm thickness (indicated as exposure B).

| Processing solutions<br>Developing solutions PQ1, PQ2 and PA: | PQ1 | PQ2 | PA |
|---|---|---|---|
| hydroquinone | 20 g | 20 g | — |
| ascorbic acid | — | — | 50 g |
| 1-phenyl-3-pyrazolidinone | 0.8 g | 0.8 g | — |
| 4-methyl,4-hydroxymethyl-1-phenyl-3-pyrazolidinone. | — | — | 4 g |
| potassium bromide | 10 g | 10 g | 10 g |
| potassium iodide | 0.1 g | 0.1 g | — |
| phenylmercaptotetrazole | 0.03 g | 0.03 g | 0.03 g |
| potassium thiocyanate | 2.5 g | 2.5 g | 2.5 g |
| polyglycol (M.W. 400) | 10 ml | 10 ml | 10 ml |
| aqueous potassium sulphite (655 g/l) | 150 ml | 100 ml | 100 ml |
| aqueous potassium carbonate (765 g/l) | 40 ml | 40 ml | 80 ml |
| aqueous potassium hydroxyde (755 g/l) | 10.4 ml | 28 ml | 10 ml |
| Trilon B (trade name for $Na_4EDTA$ from BASF) | 4 ml | 4 ml | 4 ml |
| Turpinal 2NZ (trade name for 1-hydroxy-ethyldiphosphonic acid disodium salt from HENKEL) | 1 g | 1 g | 1 g |
| pH | 10.85 | 10.85 | 10.15 |
| Water to make 1 liter. | | | |
| Fixing solution (Fixer F) | | | |
| Sodium thiosulphate | 200 g | | |
| Potassium metabisulphite | 25 g | | |
| pH = 4.9 to 5.2 | | | |
| Water to make 1 liter. | | | |

A series of 5 film materials of the type described hereinbefore was prepared. In table I the silver halide crystal diameter (μm), the degree of heterogeneity (v) expressed as the ratio between the standard deviation s of the crystal diameter and said average diameter μ, pH and pAg (expressed in mV vs. Saturated Calomel Electrode) are summarized as well as the amount of water absorbed pro gram of gelatin in the previously described circumstances as a useful indicator for the degree of hardening of the film material. The emulsions were chemically ripened during about 2.5 hours and coated as described hereinbefore.

As a comparative example STRUCTURIX D4p, an Agfa-Gevaert trademarked product, was taken as a practical material used for nondestructive testing purposes, the silver halide crystals of which are silver bromoiodide emulsions containing 1 mol % of iodide ions, built in homogeneously in the silver halide crystals having a round-off cubic habit and a crystal diameter of about 0.4 μm.

TABLE I

| Emulsion type or number | μ | v | pH | pAg | $H_2O$/g of gelatin |
|---|---|---|---|---|---|
| D4p (comp.) | 0.40 | 0.25 | | | 2.8 |
| 1 (inv.) | 0.38 | 0.20 | 5.0 | 144 | 2.0 |
| 2 (inv.) | 0.35 | 0.24 | 5.0 | 142 | 1.7 |
| 3 (inv.) | 0.37 | 0.21 | 5.0 | 127 | 2.2 |
| 4 (inv.) | 0.37 | 0.21 | 5.0 | 127 | 2.0 |
| 5 (inv.) | 0.37 | 0.21 | 5.0 | 127 | 1.8 |

Sensitometric results after exposure and processing of the corresponding film materials are given in Table II.

As a typical example of an automatic machine processing cycle, the films were run in a STRUCTURIX NDT-M machine marketed by Agfa-Gevaert and processed with an adapted processing speed at 28° C. In the automatic processing machine the materials according to the invention were run in the PQ1- or PQ2-developer whereas the comparative Structurix-material was run in the commercially available Agfa-Gevaert NDT-developer G135.

Sensitometric results are also given for a manual development cycle at 25° C. in developer PQ1 and PQ2 for the materials of the invention and in the commercial G128 developer of Agfa-Gevaert. The sensitometrical results list fog, log K at a density of 2.0 (a lower value of log K indicating a higher film speed) and the local gradient at densities D-2.0 (G2) and D=4.0 (G4).

In the above processings development was followed by a fixation step using Agfa-Gevaerts commercial G335 fixer containing ammoniumthiosulphate for the comparative materials, and using the ammonium free fixer F of the above composition for materials according to this invention.

Replenishment rates could be lowered about 50% compared with the comparative conventional system (Structurix D4p film with G135 as developer and G335 as fixer) to amounts of 400 ml/m$^2$, respectively 600 ml/m$^2$ for developer PQ2 and fixer F, said amounts to be added to compartments each containing 6.5 liters of developing, respectively fixing solution.

TABLE II

| Material | Exposure | Developer | Total processing time | Fog | log K | local gradient G2 | local gradient G4 |
|---|---|---|---|---|---|---|---|
| | | | automatic machine processing NDT-M | | | | |
| D4p (comp.) | B | G135 | 8 min. | 0.14 | 1.96 | 5.51 | 6.49 |
| 2 | B | PQ2 | 2 min. | 0.15 | 1.96 | 5.14 | 7.05 |
| 2 | B | PQ2 | 3 min. | 0.18 | 1.90 | 6.12 | 7.26 |
| D4p (comp.) | A | G135 | 8 min. | 0.14 | 2.03 | 5.20 | — |
| 2 | A | PQ2 | 2 min. | 0.15 | 1.97 | 4.47 | — |
| | | | manual processing 25° C. | | | | |

TABLE II-continued

| Material | Exposure | Developer | Total processing time | Fog | log K | local gradient G2 | local gradient G4 |
|---|---|---|---|---|---|---|---|
| | | | development time | | | | |
| D4p (comp.) | B | G128 | 3 min. | 0.15 | 1.98 | 4.17 | 6.95 |
| D4p (comp.) | B | G128 | 35 s | 0.13 | 2.27 | 3.94 | — |
| 2 | B | PQ2 | 35 s | 0.13 | 1.92 | 4.34 | 7.77 |
| 3 | B | PQ1 | 30 s | 0.13 | 1.83 | 4.55 | 7.69 |
| 4 | B | PQ1 | 30 s | 0.13 | 1.85 | 4.49 | 7.92 |
| 5 | B | PQ1 | 30 s | 0.13 | 1.87 | 4.43 | 8.05 |
| D4p (comp.) | A | G128 | 3 min. | 0.16 | 1.68 | 4.21 | — |
| D4p (comp.) | A | G128 | 40 s | 0.13 | 1.82 | 4.02 | — |
| 2 | A | PQ2 | 40 s | 0.15 | 1.69 | 4.48 | — |
| 3 | A | PQ1 | 30 s | 0.13 | 1.64 | 4.68 | — |
| 4 | A | PQ1 | 30 s | 0.13 | 1.66 | 4.60 | 7.94 |
| 5 | A | PQ1 | 30 s | 0.13 | 1.68 | 4.51 | 7.95 |

Noise values ($\sigma_D$) for the automatically processed materials at a density of 2.0 are 0.020; 0.020; 0.021; 0.019 and 0.020 respectively, indicating only small, neglectable differences.

As can be seen from table II the materials according to the present invention for non-destructive testing purposes can be developed in automatic machine processing as well as in manual processing in a hardener-free 1-phenyl-3-pyrazolidinone-hydroquinone developer during a remarkably shorter time (2 min. vs. 8 min. ) than the comparative D4p material and can be fixed without making use of ammonium ions in the fixer. In manual processing conditions it is even possible to reach an equivalent sensitometry as the comparitive example after 30 s, the comparitive example having a standard development time of 3 min. in this particular case. Nevertheless it should be stated that the automatic machine processing stays the most preferred. By the reduced water absorption due to the coating of less gelatin and the stronger hardening of the material according to the invention, it is quite clear that in the rapid processing cycle the drying conditions are not a problem either.

EXAMPLE 2

The non-destructive test film material 2 from example 1 was processed in 4 different developers the composition of which is given in table III, differing in the amount of potassium iodide and potassium thiocyanate added to the developer.

TABLE III

| Ingredients | Solutions A | B | C | D |
|---|---|---|---|---|
| hydroquinone | 20 g | 20 g | 20 g | 20 g |
| 4-methyl,4-hydroxy-methyl-1-phenyl-3-pyrazolidinone | 0.8 g | 0.8 g | 0.8 g | 0.8 g |
| potassium bromide | 10 g | 10 g | 10 g | 10 g |
| potassium iodide | — | 1 g | — | 1 g |
| potassium thiocyanate | — | — | 2.5 g | 2.5 g |
| phenylmercapto-tetrazole | 0.03 g | 0.03 g | 0.03 g | 0.03 g |
| aqueous potassium sulphite (655 g/l) | 100 ml | 100 ml | 100 ml | 100 ml |
| aqueous potassium carbonate (765 g/l) | 40 ml | 40 ml | 40 ml | 40 ml |
| aqueous potassium hydroxyde (755 g/l) | 28 ml | 28 ml | 28 ml | 28 ml |
| Trilon B (trade name for $Na_4EDTA$ from BASF) | 4 ml | 4 ml | 4 ml | 4 ml |
| Turpinal 2NZ (trade name for 1-hydroxy-ethyl-diphosphonic acid disodium salt) | 1 g | 1 g | 1 g | 1 g |

TABLE III-continued

| Ingredients | Solutions A | B | C | D |
|---|---|---|---|---|
| pH | 10.85 | 10.85 | 10.85 | 10.85 |
| Water to make 1 l | | | | |

The fixing agents (fixer F) had the following composition:

| | |
|---|---|
| Sodium thiosulphate | 200 g |
| Potassium metabisulphite | 25 g |
| pH = 4.9 to 5.2 | |
| Water to make 1 l. | |

A manual processing with the 4 developers at 25° C. and the fixer F after an exposure with a radiation energy of 235 kV gives rise to sensitometric values summarized in Table IV.

TABLE IV

| Developer solutions | Fog | log K | Local gradient G2 | Local gradient G4 |
|---|---|---|---|---|
| A | 0.12 | 2.05 | 4.51 | 8.25 |
| B | 0.17 | 1.87 | 4.01 | 8.29 |
| C | 0.17 | 1.94 | 4.41 | 7.87 |
| D | 0.17 | 1.82 | 4.49 | 8.30 |

These results clearly illustrate the importance of the presence of iodide and thiocyanate ions in the developer: although fog is increasing in this case there is a remarkable increase in sensitivity as soon as iodide ions are present in the developer, and by the presence of thiocyanate ions the desired high local gradient values can be maintained.

EXAMPLE 3

Emulsion X

A AgCl-emulsion (100 mole % chloride) with an average crystal diameter of 0.64 μm was prepared in two steps. In the nucleation step, the sodium chloride solution was added at the same rate as the silver nitrate solution (3 ml/min.) into a vessel containing 900 ml of demineralised water, 38 mmoles of sodium chloride and 46 g of inert gelatin. After 5 minutes, the crystal growth step proceeded with an increasing flow rate starting at 5 ml/min. and ending after 55 minutes at 30 ml/min., the pAg value being maintained during the whole procedure at a value of 75 mV at 60° C. by variation of the flow rate of the halide solution.

Emulsion Y.

Emulsion Y was prepared as emulsion X, the difference with the previous emulsion being realised by a reduction in flow rate in the nucleation step to 1.8 ml/min and adding a halide solution of a different composition (90 mol % sodium chloride; 10 mol % potassium bromide) after 5 minutes. In the growing step the flow rate increased from 5 ml/min. to 23.4 ml/min. during 41 min 40 s and further increased up to 30 ml/min. with the 100% chloride solution during 15 minutes. The pAg was maintained at the same value as for the preparation of Emulsion 1. The emulsion according to this preparation method had a core-shell structure characterised in that the core representing a crystal volume of 60% by weight had a local bromide concentration of 10 mol %, with an average value of 6 mol % calculated over the whole crystal volume. The average crystal diameter was exactly the same as for Emulsion X: 0.64 μm.

Emulsion Z.

Emulsion Z was prepared in the same way as emulsion Y the differences being related to the composition of the second halide composition viz. 85 mole % of sodiumchloride and 15 mole % of potassium bromide and to the flow rate in the growing step increasing from 5 ml/min. to 13.9 ml/min. in 20 min 12 s. Further increase of the flow rate up to 30 ml/min. in 36 min 25 s occurred with the 100% chloride solution. The average crystal diameter of this core-shell emulsion was 0.62 μm, with an average bromide concentration of 3 mole %, locally concentrated in the core up to 15 mole % for a volume of 20 of the whole crystal volume.

The flocculation, washing and peptising procedure was quite analogeous to that described in example 1. Amounts of chemical ripening agents were adapted to the crystal size.

The emulsions were coated at both sides of a substrated blue polyester undercoat, being 175 μm thick, making use of the slide hopper technique, the emulsion layers containing silver halide, expressed as $AgNO_3$, in an amount of 14.5 g/m$^2$ and and gelatin in an amount of 7.24 g/m$^2$. Both emulsion layers were covered with a protective layer coated at 1.40 g/m$^2$ of gelatin and hardened with formaldehyd and resorcinol to such an extent that the amount of demineralised water of 25° C. absorbed by the film pro g of gelatin was about 2.1 g after 3 minutes.

Sensitometric results obtained after applying exposure B and manual processing in developer PQ1 or PQ2 and fixing in fixer F, free of ammonium ions are given in Table V. As a reference material with a silver bromoiodide emulsion having an average crystal size of 0.7 μm, STRUCTURIX D7p was chosen, commercially available from Agfa-Gevaert. This material was manually developed in its common processing solutions G128 developer and G335 fixer marketed by Agfa-Gevaert.

TABLE V

| | | | manual processing 25° C. | | | | |
|---|---|---|---|---|---|---|---|
| | | | | | | local gradient | |
| Material | g $H_2O$/g gelatin | Developer | Development time | Fog | log K | G2 | G4 |
| D7p (comp.) | 2.93 | G128 | 3 min. | 0.19 | 1.55 | 4.09 | 6.99 |
| D7p (comp.) | 2.93 | G128 | 30 s | 0.16 | 1.83 | 3.22 | — |
| EM X | 1.75 | PQ2 | 30 s | 0.27 | 1.58 | 4.07 | 7.13 |
| EM Y | 1.75 | PQ1 | 30 s | 0.23 | 1.50 | 4.16 | 7.48 |
| EM Z | 1.75 | PQ1 | 30 s | 0.19 | 1.55 | 4.30 | 7.44 |

As can be seen from table V the materials of the invention for non-destructive testing purposes can be developed in manual processing in a hardener-free 1-phenyl -3-pyrazol idinone-hydroquinone developer during a remarkably shorter time (3 s vs. 3 min.) than the comparative STRUCTURIX D7p material. They can be fixed without making use of ammonium ions in the fixer. Besides, it has been shown that the materials of the invention can be chlorobromide core-shell emulsions as well as emulsions of pure silver chloride crystals. Core-shell emulsions with silver chlorobromide cores and silver chloride shells, with a limited amount of bromide ions, are preferred with regard to the lower fog values and higher local gradients.

EXAMPLE 4

Non-destructive testing material 2 of example 1, was developed after exposure in a developer containing ascorbic acid (developer PA) having the composition given in example 1. A comparison was made between sensitometric results obtained with this developer and the developer containing hydroquinone/1-phenyl-3-pyrazolidinone (referred to hereinbefore as PQ2) both being substantially free from hardening agents. The fixer of example 1 was used in both manual processing cycles at 25° C. The sensitometric results obtained are summarized in Table VI.

TABLE VI

| | | | | | | local gradient | |
|---|---|---|---|---|---|---|---|
| Material | Exposure | Developer | Development time | Fog | log K | G2 | G4 |
| 2 | B | PA | 35 s | 0.15 | 1.87 | 4.29 | 7.74 |
| 2 | B | PQ2 | 35 s | 0.13 | 1.92 | 4.34 | 7.77 |

As can be seen from table VI even with a hardener-free developer, containing ascorbic acid and 4-hydroxymethyl-4-methyl-1-phenyl-3-pyrazolidinone instead of hydroquinone/1-phenyl-3-pyrazolidinone it is possible to get the desired sensitometry.

We claim:

1. A photographic silver halide material for industrial radiography comprising a film support and on one or both sides thereof at least one silver halide emulsion layer characterised in that each silver halide emulsion layer comprises as silver halide emulsion crystals cubic silver chloride grains or silver chlorobromide grains with an amount of bromide therein of at most 25 mole %; has a gelatin to silver halide (expressed as silver nitrate) ratio by weight of from 3:10 to 6:10 and has an amount of silver halide corresponding to from 5 g to 15 g of silver per sq. m. and in that the photographic material has been fore-hardened to an extent such that when it is immersed in demineralised water of 25° C. for 3 minutes there is absorbed less than 2.5 g of water per gram of gelatin.

2. A photographic material according to claim 1 wherein said material is a duplitized radiographic material having a silver halide emulsion layer on both sides of the support.

3. A photographic material according to claim 1 wherein the material has been hardened to an extent that when immersed in demineralised water of 25° C. it absorbs in 3 minutes less than 2.0 g of water per gram of gelatin.

4. A photographic material according to claim 1 wherein said silver halide emulsion(s) is(are) silver chlorobromide emulsion(s) with a core-shell or multiple layer structure, the composition of the shell consisting for 100 mole % of silver chloride.

5. A photographic material according to claim 1 wherein the size distribution of the silver halide crystals is homogeneous.

6. Method of processing an exposed fore-hardened photographic material for industrial radiography according to claim 1 comprising the steps of developing, fixing, washing and drying wherein the total processing time is less than 5 minutes.

7. A method according to claim 6 wherein the developer and/or the fixer is substantially free from hardening agents.

8. A method according to claim 6 wherein the fixer is substantially free from ammonium ions.

9. A method according to claim 6 wherein said developer contains hydroquinone and a 1-phenyl-3-pyrazolidinone developing agent.

10. A method according to claim 6 wherein said developer contains ascorbic acid and 4-hydroxymethyl-4-methyl-1-phenyl-3-pyrazolidinone.

11. A method according to claim 6 wherein the developer contains thiocyanate ions in an amount of 0.1 to 10 g/l.

12. A method according to claim 6 wherein the developer contains iodide ions in an amount of 25 to 250 mg/l.

13. A method according to claim 6 wherein the fixer contains as fixing agent sodium thiosulphate.

* * * * *